United States Patent [19]

Kume et al.

[11] 4,194,351

[45] Mar. 25, 1980

[54] ELECTRONIC TIMEPIECE

[75] Inventors: Kazunari Kume; Yasushi Nomura, both of Tokorozawa, Japan

[73] Assignee: Citizen Watch Co., Ltd., Tokyo, Japan

[21] Appl. No.: 853,864

[22] Filed: Nov. 22, 1977

[30] Foreign Application Priority Data

Nov. 26, 1976 [JP] Japan ..... 51-141174

[51] Int. Cl.[2] ..... G04C 3/00

[52] U.S. Cl. ..... 368/82; 368/204; 368/88; 368/286

[58] Field of Search ..... 58/23 R, 23 BA, 50 R, 58/53, 54, 55, 56, 88 R, 88 G

[56] References Cited

U.S. PATENT DOCUMENTS

| | | | |
|---|---|---|---|
| 3,505,804 | 4/1970 | Hofstein | 58/23 BA |
| 3,540,207 | 11/1970 | Keeler | 58/23 R |
| 3,952,499 | 4/1976 | Reisman | 58/88 R |
| 3,977,176 | 8/1976 | Murakami et al. | 58/23 BA |
| 3,986,334 | 10/1976 | Harper | 58/23 BA X |
| 4,023,347 | 5/1977 | Haber | 58/23 BA X |
| 4,081,952 | 4/1978 | Busch et al. | 58/88 R X |
| 4,095,334 | 6/1978 | Uchida | 58/23 BA X |

*Primary Examiner*—Ulysses Weldon

*Attorney, Agent, or Firm*—Sherman & Shalloway

[57] ABSTRACT

An electronic timepiece having a molded casing made of resin for incorporating in one body, timepiece components including a windshield, display means including an electro-optical display element or pointers, timepiece driving means, battery cell case and external switch means.

7 Claims, 11 Drawing Figures

ELECTRONIC TIMEPIECE

BACKGROUND OF THE INVENTION

1. Field of the Invention

This invention relates to an electronic timepiece, particularly to a timepiece provided with a molded watch casing made of resin and incorporating a windshield, a display element and other timepiece composing parts in one.

2. Description of the Prior Art

Recently components of electronic timepieces, e.g. integrated circuits, crystal oscillating elements have been mass-produced to be low in cost. Assembly of these components has been extremely simplified. However in assembling the conventional electronic timepiece there are required a plate as a base plate, a bridge, a tap, a screw etc. which are not concerned with essential timepiece functions due to screw, bonding etc. for integration of the timepiece components. Therefore the number of timepiece components is increased, structures of the plate and bridge are made complicate, and its productivity is not good because of trouble in assembly.

Further the prior art watch case of the electronic timepiece is very expensive as compared with other components and its design has a large limitation.

SUMMARY OF THE INVENTION

A primary object of this invention is to provide an electronic timepiece which obviates the conventional shortcomings set forth above.

Another object of this invention is to provide an electronic timepiece which may be easily assembled and is good in its productivity.

Other object of this invention is to provide an electronic timepiece which is low in cost because of mass-production and reduction of the number of timepiece components.

Further other object of this invention is to provide an electronic timepiece which is thin in thickness and excellent in design.

According to one aspect of this invention provision is made of an electronic timepiece comprising a windshield, a display element, timepiece driving means including a time reference signal source for driving the display element, a power supply source supplying the timepiece driving means with driving energy, external switch means for externally controlling said timepiece driving means, and a molded casing made of resin and incorporating in one the windshield, the display element, the timepiece driving means and the external switch means.

DETAILED DESCRIPTION OF PREFERRED EMBODIMENTS

Figure 1:
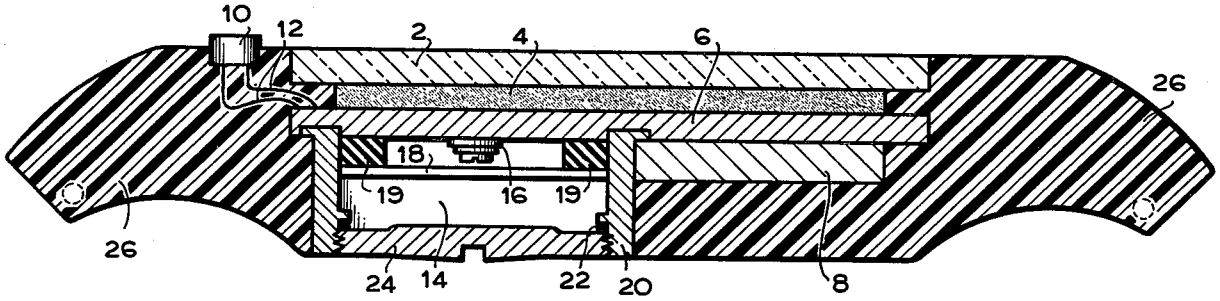
FIG. 1 is a vertical section showing one embodiment of an electro-optical type electronic timepiece according to this invention.

FIG. 1 shows a digital type, i.e. electro-optical timepiece of the invention in which reference numeral 2 depicts a windshield and a TWIST liquid crystal display cell 4 as an electro-optical display element underlies the windshield. A printed circuit board 6 underlies the TWIST liquid crystal display cell 4. Under the printed circuit board there are provided electronic components 8 inclusive of an crystal oscillating element, integrated circuit etc. to drive the TWIST liquid crystal display. A switch actuating member 10 is connected through leading wires 12 to the printed circuit board 6. A battery cell receiving chamber 14 formed by a battery cell casing 20 is also provided under the printed circuit board 6 in which a trimmer capacitor 16 is secured to the printed circuit board 6. A partition plate 18 is fitted to the printed circuit board 6 through a partition base 19. A battery cell cap 24 is threaded into the battery cell casing 20. A waterproof packing 20 is provided between the battery cell casing 20 and the battery cell cap 24 to insure tight structure. These watch components, i.e. the windshield 2, the liquid crystal display cell 4, the printed circuit board 6, the electronic components 8, the switch actuating member 10 and the watch casing 20 are wholly cooperated into one by a watch casing 26 made of resin and molded as shown in FIG. 2.

Figure 2:
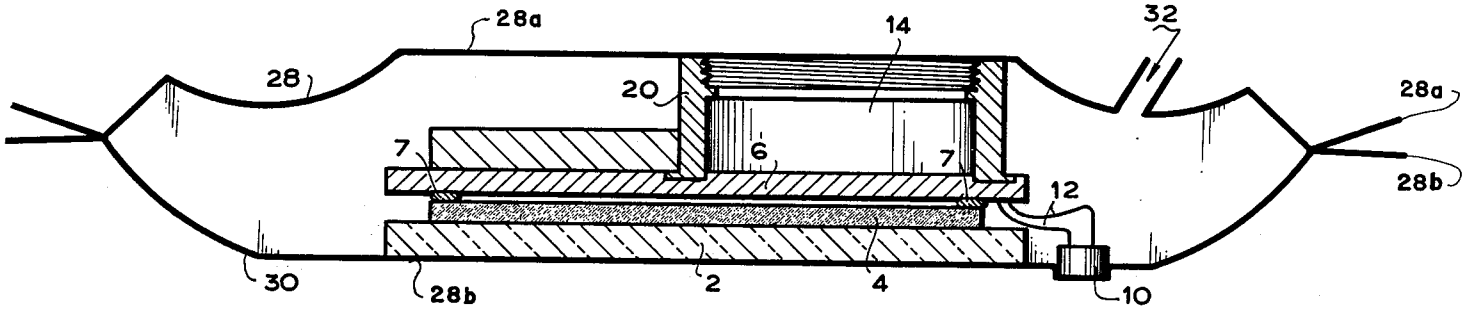
FIG. 2 is an explanatory diagram showing manufacture method of the electronic timepiece as shown in FIG. 1.

FIG. 2 is an explanatory diagram to manufacture a wholly electronic timepiece of FIG. 1 in which a split mold 28 consists of an upper half **28*a* and a lower half 28*b*, the upper half 28*a* provided with an opening 32 through which resin is blown into the split mold 28. Before the blow molding the windshield 2 and the liquid crystal display cell 4** are united into one body by bonding material to prevent resin from coming into any space therebetween.

A conductive rubber 7, not shown in FIG. 1, is sandwiched between the printed circuit board 6 and liquid crystal display cell 4 for urging the watch components to the inner faces of the mold halves **28*a*, 28*b* respectively. Therefore the printed circuit board 6 and the liquid crystal display cell 4 is made conductive with each other by strong pressure from the inner face of the split mold 28 through the battery cell casing 20 which is secured to the printed circuit board 6 such that resin does not come into the battery cell casing 20. Thus there can be easily obtained wholly electronic timepieces with watch casings of various design by changing the shape of the split mold 28**.

In the embodiment of FIG. 1 in which TWIST liquid crystal display cell 4, preferably resin is blown into the split mold 28 at room temperature or so since its beat resisting temperature is 70° to 80° C.

Figure 3:
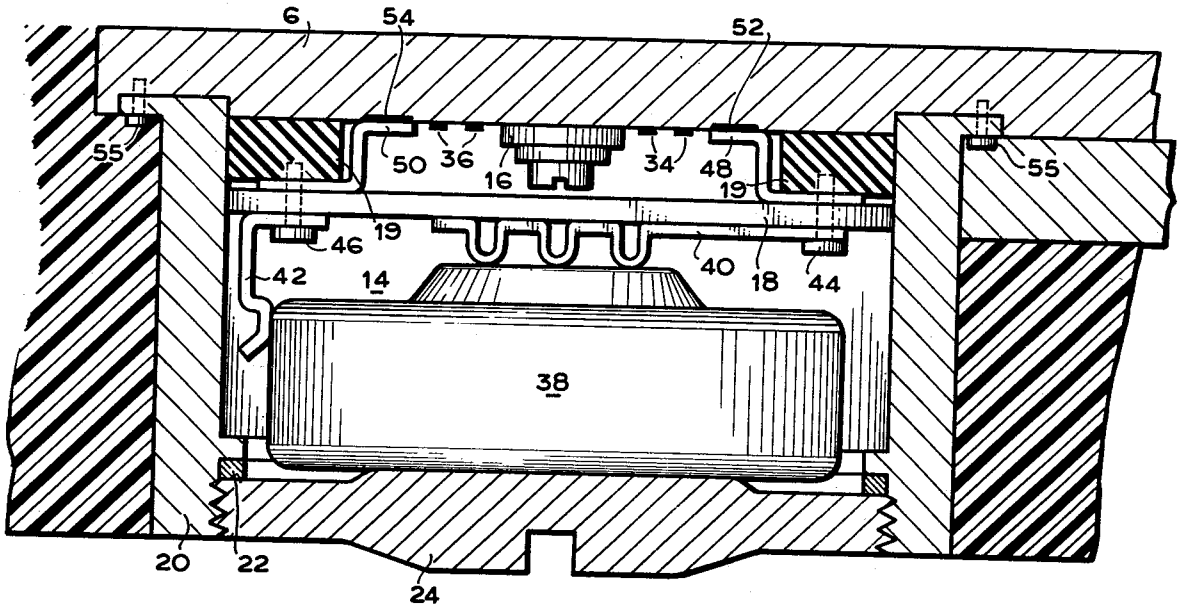
FIG. 3 is an amplified view of a battery cell receiving chamber as shown in FIG. 1.

FIG. 3 is an amplified view of the battery cell receiving chamber 14 shown in FIG. 1.

The battery cell receiving chamber 14 is divided into two partitions by the partition plate 18. In the room adjacent to the printed circuit board 6, there are provided the trimmer capacitor 16, an adjustment terminals 34 and detection terminals 36. As shown in FIG. 1 the battery cell cap 24 is threaded into the battery cell casing 20. The battery cell cap 24 is taken off and then the partition plate 18 is taken from the battery cell receiving chamber 14 so that there can be effected detection and adjustment of the watch integrated circuit. This structure is advantageous because it is not required to provide another chamber opened toward the outside of the timepiece. In other words, this may obviate the necessity of provision of another casing in lieu of the battery cell receiving casing 20 and another cap to tightly close it and thereby simplifying a timepiece structure to reduce the manufacture cost.

In the other partition of the battery cell receiving chamber 14 there is accomodated the battery cell 38. The partition plate 18 is provided with a cathode terminal 40 and an anode terminal 42, each being made of spring material. These terminals 40, 42 function as a battery cell supports. These are secured to the partition base 19 made of insulation material by means of screws 44, 46 so as to be connected to conductive member 48, 50 which make contact with conductive portions 52, 54 and thereby power being derived from the battery cell 38. The adjustment terminal 34, detection terminal 36, trimmer capacitor 16 and conductive portions 52, 54 on the printed circuit board 6 are connected to the opposite side of the printed circuit board 7 via through holes. Further conductive patterns on the opposite side of the printed circuit board 6 leads to the integrated circuit. Similarly the electronic components 8 are connected to the conductive pattern via the through holes. This is the reason why direct connections between the interior and exterior of the battery cell receiving chamber 14 are impossible since the battery cell casing 20 is fixed to the printed circuit board 6 by means of screws 55 such that a fixture portion 55*a* of the battery cell casing 20 encroaches upon or lie burried in the printed circuit board 6. Therefore this structure of fixing the battery cell casing 20 to the printed circuit board 6 insures the fixture of the battery cell casing even when the battery cell cap 24 is put on and off. Strong bonding material may be utilized instead of the screws 55 to fix the battery cell casing 20 to the printed circuit board 6.

Figure 4:
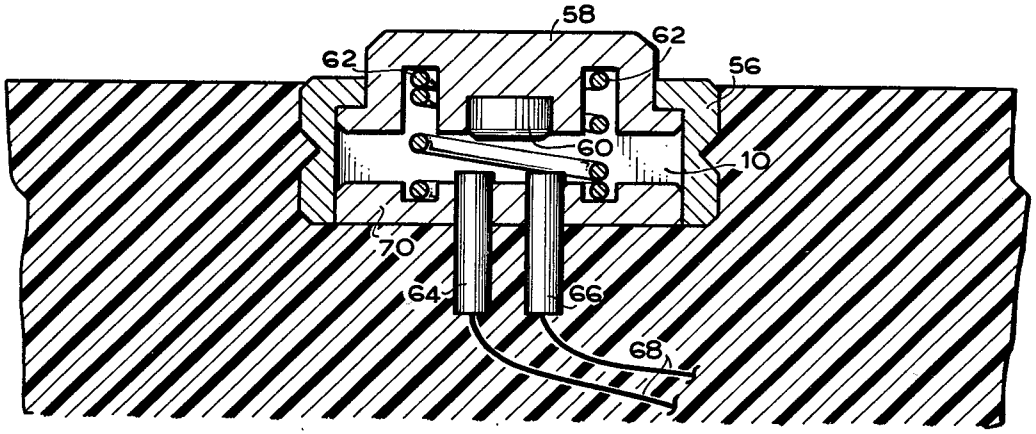
FIG. 4 is an amplified view of a switch actuating member as shown in FIG. 1.

FIG. 4 is an amplified view of the switch actuating member 10 shown in FIG. 1. The switch actuating member 10 comprises a switch case 56, a push button 58, a contact 60, a spring 62, switch terminals 64, 66, leading wire 68 and a switch base 70. When the timepiece is assembled in one body by blowing resin into the split mold 28 (FIG. 2), the switch base 70 and switch case 56 prevent resin from coming in the switch actuating member 10. Actual switch input operation is effected by pushing the push button 58 and making the contact 60 contact with the switch terminal 64, 66 to make the switch terminals 64, 66 conductive with each other.

Figure 5A:
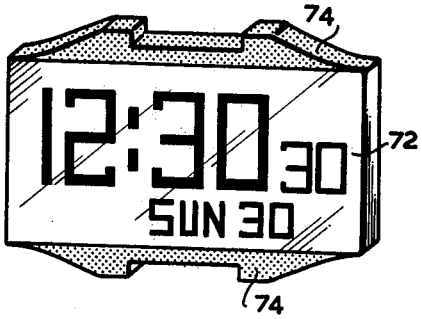
FIGS. 5A to 5C are perspective views showing another embodiment of an electro-optical type electronic timepiece according to this invention.
Figure 5B:
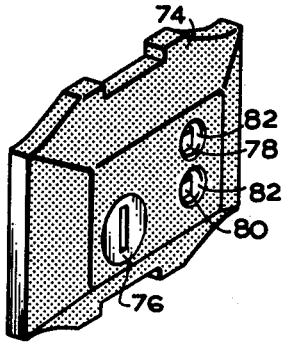
Figure 5C:
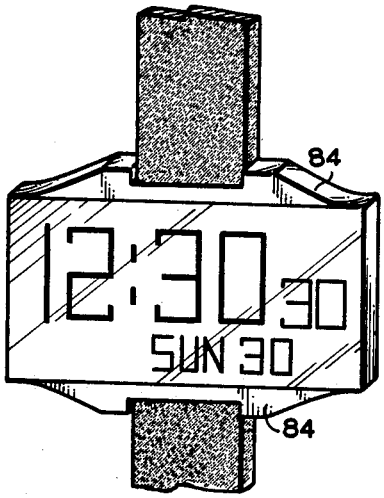

FIGS. 5A to 5C show another embodiment of this invention wherein there is shown an example of a liquid crystal display type watch. According to this embodiment both side faces of a windshield 72 are exposed from the watch while its upper and lower faces as well as its rear face are solidified by molded resin 74. There are formed on the rear side of the watch recesses 82 in which a battery cell cap 76, a select switch actuating member 78 and a set switch actuating member 80. Thus the switch actuating members 78, 80 are not erroneously operated when one wears the watch. The other structure is similar to that of the watch shown in FIG. 1. The resin coated portion 74 is further coated with metal and then finished by plating so that there is formed a plated layer 84 as shown in FIG. 5C.

Figure 6:
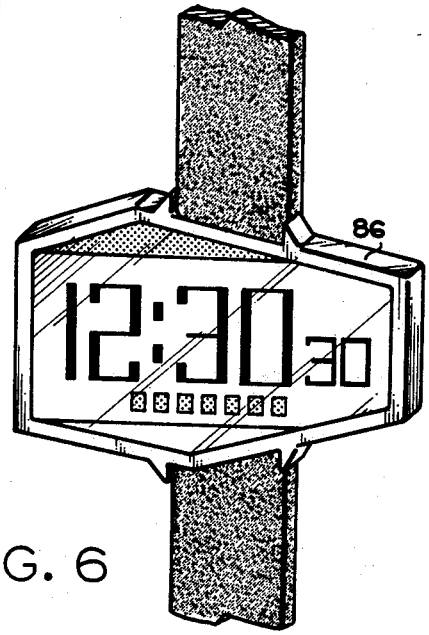
FIG. 6 is a perspective view of other embodiment of an electro-optical type electronic timepiece according to this invention.

FIG. 6 shows other embodiment of a liquid crystal display timepiece according to this invention wherein reference numeral 86 illustrares a watch casing frame which is formed by coating of molded resin and further plating with metal. This embodiment enables it to manufacture a watch with special and unique shape only by monstrous cell and windshield.

Figure 7:
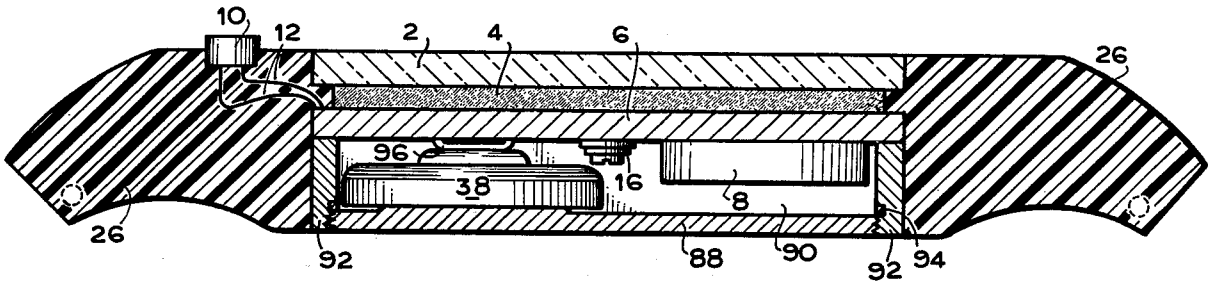
FIG. 7 is a vertical section of still further embodiment of an electro-optical type electronic timepiece according to this invention.

FIG. 7 shows still other embodiment of a liquid crystal display cell according to this invention wherein provision is made of a movement chamber 90 opened to the exterior of the watch by putting off a back cover 88 therefrom. A packing 92 is sandwiched between the movement chamber 90 and the back cover 88 to prevent water from coming in the movement chamber 90. The battery cell 38 is received by the movement chamber 90, and cathode terminal 96 and anode terminal (not shown) are provided in the movement chamber 90. In this embodiment the trimmer capacitor 16 and the battery cell is arranged without overlap with each other so as to thin the whole thickness of the watch to that extent.

Figure 8:
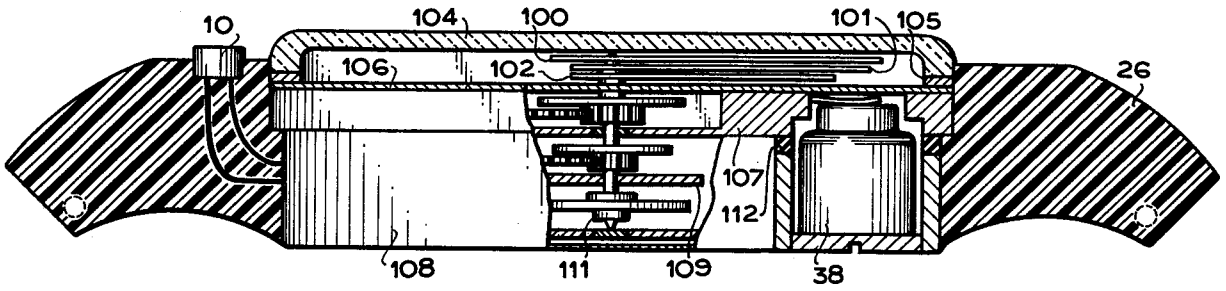
FIG. 8 is a vertical section showing still further embodiment of a hand-type electronic timepiece according to this invention.

FIG. 8 shows another embodiment of an analogue type, i.e. hand-type electronic timepiece with a second pointer 100, a minute pointer 101 and an hour pointer 102. Reference numeral 104 denotes a windshield, and a spacer 105 is interposed between the windshield 104 and a dial 106 for preventing resin from coming in the interior. The dial 106 is mounted on the base plate 107 in a metal case 108. In the metal case 108, there are also provided a sweep second cock 109 and a wheel train base 110 as well as wheel trains 111. Further other components, e.g. a crystal oscillator and a capacitor, not shown are enclosed in the metal case 108. Of course, these components may be provided outside of the case 108. The metal case 108 may be exposed outside of the timepiece, but it may be covered with the resin 26. The metal case 108 may be replaced by a resin case. The wheel train base 110 also functions as a printed circuit board. Reference numeral 112 depicts an insulation ring. As apparent from this embodiment, this invention can be adapted to hand-type timepiece as well as an electro-optical type timepiece.

Figure 9:
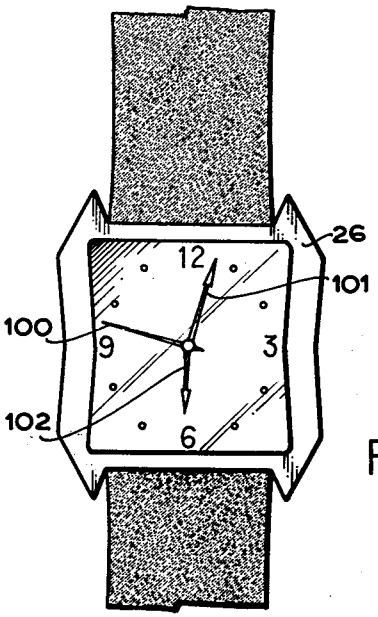
FIG. 9 is a plan view showing still further embodiment of a hand-type timepiece according to this invention.

FIG. 9 shows a hand-type timepiece in which the watch casing made of resin is further plated with metal.

As apparent from the above embodiment this invention provides various useful effects. Namely according to this invention there can be obtained a timepiece light in weight because of resin watch casing, thin in thickness because of rational arrangement as a whole, unique in appearance because of no limitation in metal cutting technology and of possibility of coloring. In addition, it is possible to exclude the conventional user's belief that a resin casing is not a high-class article if the resin casing is plated with metal. Of course, it is easy to assemble a timepiece of this invention and its cost can be reduced.

It will thus been seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

For example, in the above embodiments, there are described liquid crystal display timepiece as a digital timepiece, but it is easily replaced by other electro-optical display timepiece with light emission diode elements, electrochromic elements etc. And the hand-type timepiece set forth above may be replaced by other analogue type timepieces.

What is claimed is:

1. In an electronic timepiece including a unitary, interconnected structure comprising a windshield, display means adjacent the windshield, timepiece driving means including a time reference signal source for driving the display means, a battery cell case receiving a battery cell supplying the timepiece driving means with driving energy, and external switch means for externally controlling said timepiece driving means and a molded casing made of resin formed about and incorporating into a unit said windshield, said display means, said timepiece driving means, said battery cell case and said external switch means the improvement comprising said timepiece driving means including a printed circuit board carrying the time reference signal source, wherein said display means is sandwiched between the windshield and the printed circuit board, and wherein said battery cell case is adjacent the printed circuit board and has a partition therein forming first chamber for enclosing a trimmer capacitor attached to the printed circuit board and forming a second chamber for receiving the battery cell supplying the timepiece driving means with driving energy.

2. An electronic timepiece as claimed in claim 1 wherein said display means consists of an electro-optical display element.

3. An electronic timepiece as claimed in claim 1 wherein said battery cell case is secured to a printed circuit board of said timepiece driving means by securing means and is provided with a battery cell cap to make exchange of said battery cell possible.

4. An electronic timepiece as claimed in claim 4 wherein said battery cell case is provided with detection and adjustment terminals therein.

5. An electronic timepiece as claimed in claim 1 wherein said external switch means includes a switch case and a switch base for preventing the resin from coming therein.

6. An electronic timepiece as claimed in claim 1 wherein said molded casing is a split molded casing having an opening therein for receiving a blow molded portion formed about and incorporating into a unit said windshield, said display means, said timepiece driving means, said battery cell case and said external switch means.

7. An electronic timepiece as claimed in claim 6 wherein said timepiece driving means includes a printed circuit board carrying the time reference signal source for driving the display means, wherein said printed circuit board is adjacent to and electrically connected to said display means by a conductive rubber.

* * * * *